US008286806B2

(12) United States Patent
Norris

(10) Patent No.: US 8,286,806 B2
(45) Date of Patent: Oct. 16, 2012

(54) STORAGE DEVICE FOR CALL CORDS AND RELATED PATIENT CARE EQUIPMENT

(76) Inventor: Joseph William Norris, Nepean (CA)

( * ) Notice: Subject to any disclaimer, the term of this patent is extended or adjusted under 35 U.S.C. 154(b) by 319 days.

(21) Appl. No.: 12/802,393

(22) Filed: Jun. 4, 2010

(65) Prior Publication Data

US 2010/0320160 A1 Dec. 23, 2010

(30) Foreign Application Priority Data

Jun. 5, 2009 (CA) ..... 2668418

(51) Int. Cl.
*A47F 5/08* (2006.01)
*A47F 7/00* (2006.01)

(52) U.S. Cl. ..... 211/26.1; 211/106.01; 248/220.22; 248/224.7; 248/301

(58) Field of Classification Search ..... 211/26–26.2, 211/86.01, 87.01, 106.01, 70.1, 61, 62, 85.9, 211/70.6; 248/220.22, 224.7, 225.21, 301, 248/304, 917
See application file for complete search history.

(56) References Cited

U.S. PATENT DOCUMENTS

| | | | | |
|---|---|---|---|---|
| 2,577,988 | A * | 12/1951 | Wirth | 211/70.6 |
| 2,614,701 | A * | 10/1952 | Mapson | 211/87.01 |
| 2,985,315 | A * | 5/1961 | Paruolo | 211/189 |
| 3,458,946 | A * | 8/1969 | Lasswell | 40/657 |
| 4,162,015 | A * | 7/1979 | Hodges | 211/87.01 |
| 4,484,367 | A | 11/1984 | Jenkins | |
| 4,672,703 | A | 6/1987 | Frazier | |
| D316,956 | S * | 5/1991 | Hoskinson et al. | D8/371 |
| 7,048,242 | B2 * | 5/2006 | Oddsen, Jr. | 248/280.11 |
| 7,543,787 | B2 * | 6/2009 | Chen | 248/225.21 |
| 7,789,248 | B1 * | 9/2010 | Salerno et al. | 211/85.7 |
| 2005/0045794 | A1 * | 3/2005 | Richter | 248/371 |
| 2008/0156754 | A1 * | 7/2008 | Cheng | 211/70.6 |
| 2008/0257841 | A1 * | 10/2008 | Abernathy | 211/87.01 |

FOREIGN PATENT DOCUMENTS

| | | |
|---|---|---|
| CA | 1 058 577 | 7/1979 |
| CA | 2 586 188 | 10/2007 |

* cited by examiner

*Primary Examiner* — Michael Safavi
*Assistant Examiner* — Devin Barnett
(74) *Attorney, Agent, or Firm* — Flynn, Thiel, Boutell & Tanis, P.C.

(57) ABSTRACT

A storage device for items connectable to a power source, particularly in patient care facilities. The device is attachable to an electrical power box in a support surface. A backing plate securable to the support surface has an upper free edge and a lower region defining a substantially planar intermediate region therebetween. A power supply aperture in the intermediate region allows for selective power connection between the power box and stored items. A base shelf at the lower region of the backing plate, and a projections from the free edge of the base shelf, provide securing locations for selected items. Removable bracket units for specific items can be secured on the projections. The device provides improved means of secure, hygienic, compact and efficient storage and access to the items, while overcoming disadvantages of health and safety hazards of the prior art.

12 Claims, 5 Drawing Sheets

STORAGE DEVICE FOR CALL CORDS AND RELATED PATIENT CARE EQUIPMENT

CROSS-REFERENCE TO RELATED APPLICATIONS

This Application relates to and claims priority to Canadian Patent Application No. 2,668,418 filed Jun. 5, 2010, entitled STORAGE DEVICE FOR CALL CORDS AND RELATED PATIENT CARE EQUIPMENT, the entirety of which is incorporated herein by reference.

FIELD OF THE INVENTION

This invention relates to storage devices, in particular to storage devices for items used in patient care facilities. More particularly, the invention relates to a storage device providing compact, safe and secure storage for call cords and similar smaller items generally capable of being hand-held, particularly those requiring continuous connection to a power supply.

BACKGROUND OF THE INVENTION

In patient care facilities, in addition to larger machines and devices which are mounted on docking stations and the like, various smaller items are required to be kept adjacent to the patient. Some of these items require continuous connection to a-power supply, such as call cords for alerting nurses or other care attendants, and similar alert devices, as well as smaller items of monitoring equipment for vital signs or other routine in situ tests.

It is known to provide customized wall docking stations for larger equipment such as monitors which are required to be connected to the main power supply, where the connection is continuous and any movement of the equipment during use is by manipulation of part or all of the docking station, such as an extendable or articulated arm.

It is also known to provide storage devices for smaller patient care items which are not required to be connected to a power supply. Such devices include wall-mounted shelving, or trays or the like which can be removably attached to desired locations on beds or other hardware.

Call cords and similar alerting devices often present particular problems, in that they require constant connection to a power supply, but the alerting button portion is required to be close to and accessible by the patient at all times. This can present problems of safety and security, where the cord may present an obstruction or hazard to patients or personnel, or of hygiene where the button portion of a cord is unclipped or otherwise detached from its usual location, and that portion touches the ground or other unclean surface.

Further, where a cord of an alerting device is disconnected in order to allow some physical movement in a patient room, an unnecessary alarm may sound as a result of the disconnection, wasting valuable time and resources of staff attending to such alarm.

Other items regularly used in patient care rooms can suitably and safely be kept in the rooms, but are subject to being dropped, contaminated, or otherwise damaged or compromised where there is no appropriate storage which keeps them accessible as needed but protected from accident or misuse, for example where the patient has physical or mental problems which give rise to behaviours which interfere with such equipment.

SUMMARY OF THE INVENTION

The invention therefore seeks to provide a storage device for items connectable to a power source, the device being constructed and arranged to be attachable to an electrical power box in a support surface and comprising:

a. a backing plate securable to the support surface and having an upper free edge and a lower region defining a substantially planar intermediate region therebetween, and a power supply aperture in the intermediate region constructed and arranged to allow a power connection between the power box and selected ones of the items;

b. a base shelf affixed to the lower region of the backing plate; and c. a plurality of projections from at least one free edge of the base shelf each constructed and arranged to provide securing locations for selected ones of the items.

Preferably, the base shelf is substantially rectilinear and each projection has substantially planar inner and outer surfaces and is angled outwards from an upper surface of the base shelf, such that the inner surface defines an obtuse angle $\alpha$ of less than 180° with the upper surface of the base shelf. More preferably, each projection has a tapered outer free end.

Preferably, the device also comprises at least one securing means each constructed and arranged to be received on any one of the projections and to selectively receive selected ones of the items. More preferably, each securing means comprises an attachment bracket comprising:

(i) a sleeve member configured to cooperate with a configuration of at least one of the projections;

(ii) a face plate member having a front surface and a rear surface and constructed and arranged to receive and securely retain selected ones of the items; and (iii) an intermediate connecting member attached to the sleeve member and the rear surface of the face plate member, wherein when the device is secured to the support surface and the sleeve member is located on one of the projections, the face plate member is retained in a substantially vertical position.

Preferably, the intermediate connecting member is affixed to the face plate member at a joint region to define at a lower aspect of the joint region an obtuse angle substantially equal to the obtuse angle $\alpha$.

The face plate member is constructed and arranged to secure the selected ones of the items by gravity, or by an interference fit, or can further comprise securing locations constructed and arranged to receive fastening means to selectively secure the selected ones of the items to the face plate member.

Preferably, the projections have a substantially triangular configuration having its apex at the tapered free end.

Preferably, the power supply aperture is constructed and arranged to conform to a standard power box configuration selected from a single box, a four-by-four box and a multiple gang box. Preferably, the backing plate is custom made to accommodate any given electrical power box configuration.

Preferably, the backing plate, the base shelf and the projections comprise an integrally constructed unit, constructed of a material selected from metal and plastic. Optionally, for increased protection from accidental injury from protruding portions of the device, a covering element can be provided over those portions, for example a removable cover made of a relatively soft and flexible material, or a spray coating can be applied in a manner to provide a rounded contour over sharper edges.

Preferably, the attachment bracket is also constructed of a material selected from metal and plastic.

BRIEF DESCRIPTION OF THE DRAWINGS

The invention will now be described with reference to the drawings, in which.

DETAILED DESCRIPTION OF THE DRAWINGS

Figure 1:
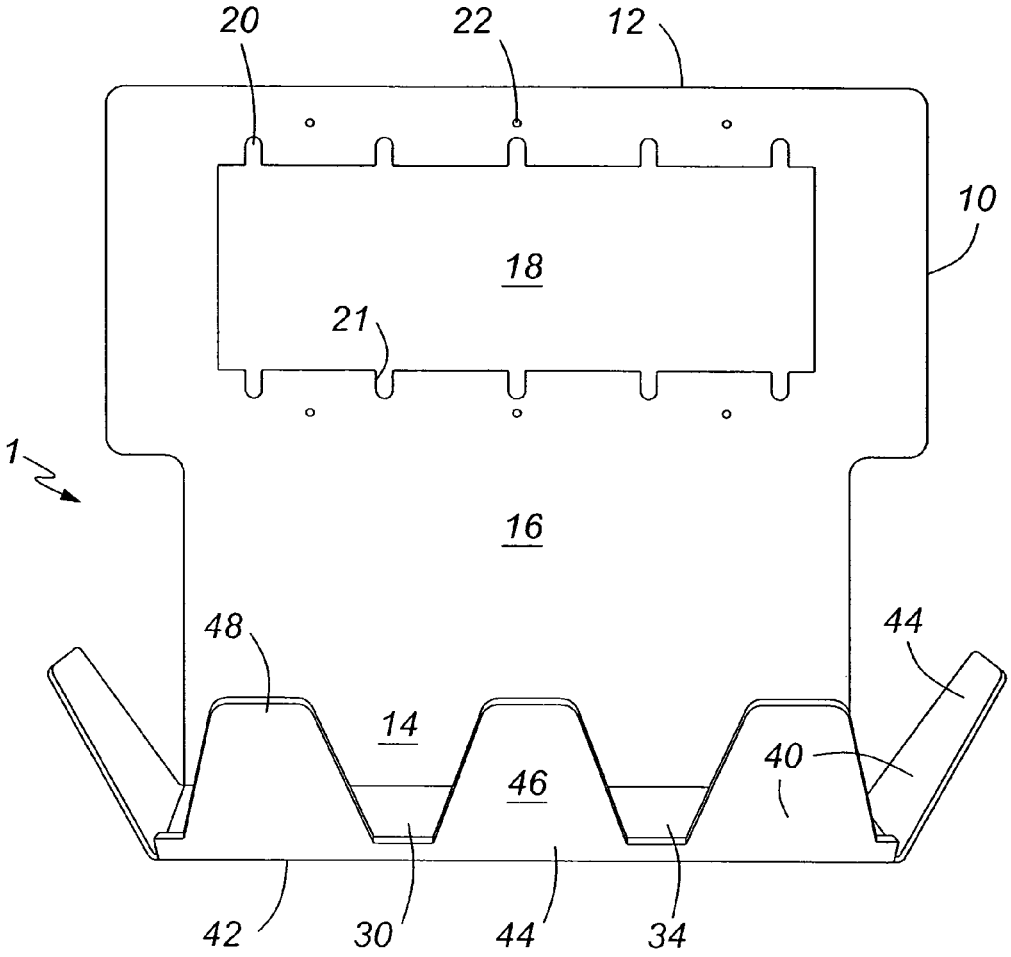
FIG. 1 is a front view of a device in an embodiment of the invention.

FIG. 1 shows a first embodiment of the device 1 without the use of a bracket. The device 1 comprises a backing plate 10 having an upper free edge 12, a lower region 14 and a substantially planar intermediate region 16 therebetween. The backing plate 10 is securable to a support surface, such as a wall in a patient care facility.

The intermediate region 16 comprises a power supply aperture 18 which is constructed and arranged to allow a power connection between a power box (not shown) in the support surface and items (not shown). Items may comprise devices that require continuous connection to a power supply, such as call cords for alerting nurses or other care attendants, and similar alert devices, as well as smaller items of monitoring equipment for vital signs or other routine in situ tests. The power supply aperture 18 comprises a plurality of notches 20, and in a suitable area of the backing plate 10, preferably proximate the upper and lower edges of the aperture 18, a plurality of holes 22 are provided. The notches 20 are used to secure the device 1 to the electrical power box in the support surface. In patient care facilities, the underlying power source is rarely installed in a level manner. This can create problems for attached shelving or other items which are required to be horizontal, and may also be disconcerting to patients who observe the medical equipment emanating from the power source as being crooked with respect to the walls of the facility. The notches 20 provide a means of adjusting the orientation of the device 1 with respect to the support surface, so that the device can be oriented in a level manner, even when the underlying power source is not. Preferably, the notches 20 have a chamfered portion 21, which prevents unwanted movement of the device 1 in relation to the support surface. To install the device 1, fastening means can be provided such as screws or posts (not shown), which are inserted into the notches 20 to fix the device 1 to the electrical power box. The fastening means are inserted into the notches 20 to correctly position the device 1 so that it is properly aligned with the underlying power source, while at the same time being oriented in a level manner with respect to the support surface. The holes 22 are threaded, as in a standard electrical power box hole configuration, and serve as points of attachment for nurse call equipment and other items to the device 1.

The device 1 further comprises a base shelf 30 having an upper surface 34. The base shelf 30 is joined to the backing plate 10 of the device 1 by an edge 32 of the base shelf 30 (shown in FIG. 5). The base shelf 30 can be used to store items, patient charts and/or a patient's personal belongings.

A plurality of projections 40 extends from at least one free edge 42 of the base shelf 30. Each projection 40 has a surface 44 adjacent to the base shelf 30, an opposing outer surface 46 and an apex 48. Each projection is angled from the upper surface 34 of the base shelf 30, such that the surface 44 defines an angle $\alpha$ (shown in FIG. 5). It will generally be preferable for the angle $\alpha$ to be at least 90° so as to prevent the projection 40 from obstructing or coming into contact with items, patient charts and/or a patient's personal belongings that are being stored on the base shelf 30. Further, the angle $\alpha$ can be suitably selected according to the configuration of the projections, so as to provide an optimal angle for items supported on the projections, as discussed further below, and in most cases will preferably be less than 120°. Each projection 40 is constructed and arranged to provide a securing location for an item. Cords of medical devices (not shown), including call cords, may be wrapped around or hung from the projections 40, or placed onto the base shelf 30 when there is no patient in the room, so that the cords do not present an obstruction or hazard to patients or personnel, or raise a hygiene issue where the cord may touch the ground or other unclean surface. Each projection 40 may have a tapered outer free end. Additionally, each projection 40 may have a substantially triangular configuration having its apex at the tapered free end. While FIG. 1 shows three projections 40 from the leading aspect of free edge 42 of the base shelf 30 and one projection 40 from each lateral aspect of free edge 42 of the base shelf 30, the number of projections 40 and their respective sizes and configurations may be varied. Additionally, the sizes and configurations of the respective projections 40 do not need to be identical.

As noted above, further protection from inadvertent injury from contact of personnel or a patient with protruding portions of the device can be provided in the form of a cover placed over those portions, or a coating applied to them. Thus, a cover (not shown) can advantageously be applied over the projections 40 to provide a soft surface in the region of the apices 48, or a coating applied to the peripheral edges of the projections 40 at least proximate the apices 48.

Figure 2:
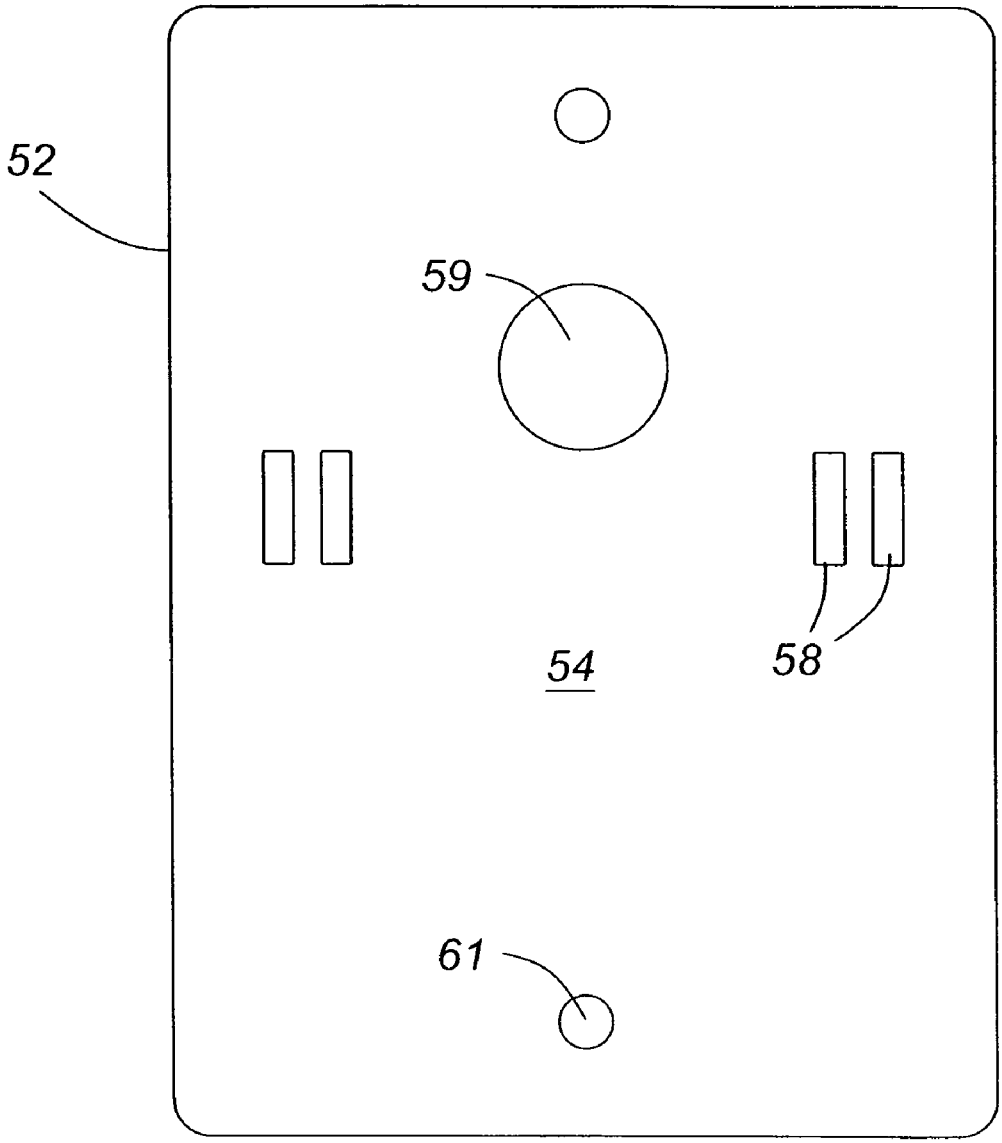
FIG. 2 is a front view of the face plate of an attachment bracket of the invention.
Figure 3:
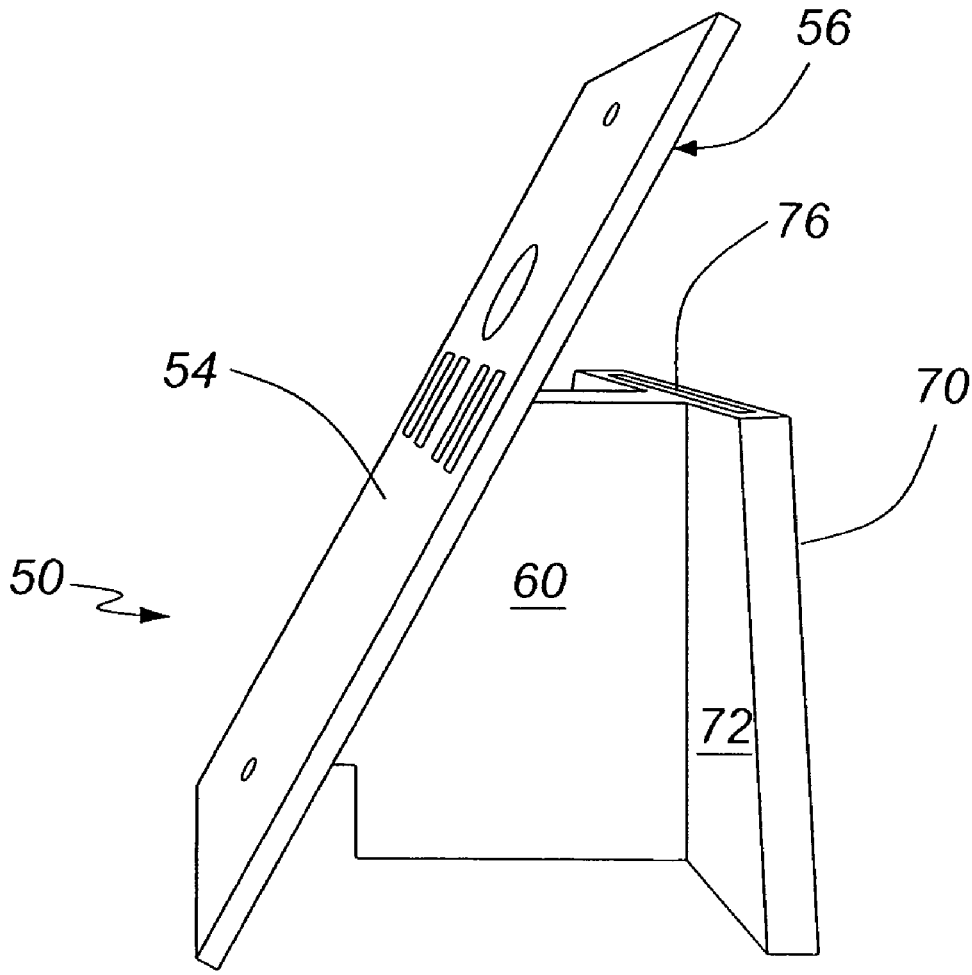
FIG. 3 is a perspective partial side view of an attachment bracket of the invention.
Figure 4:
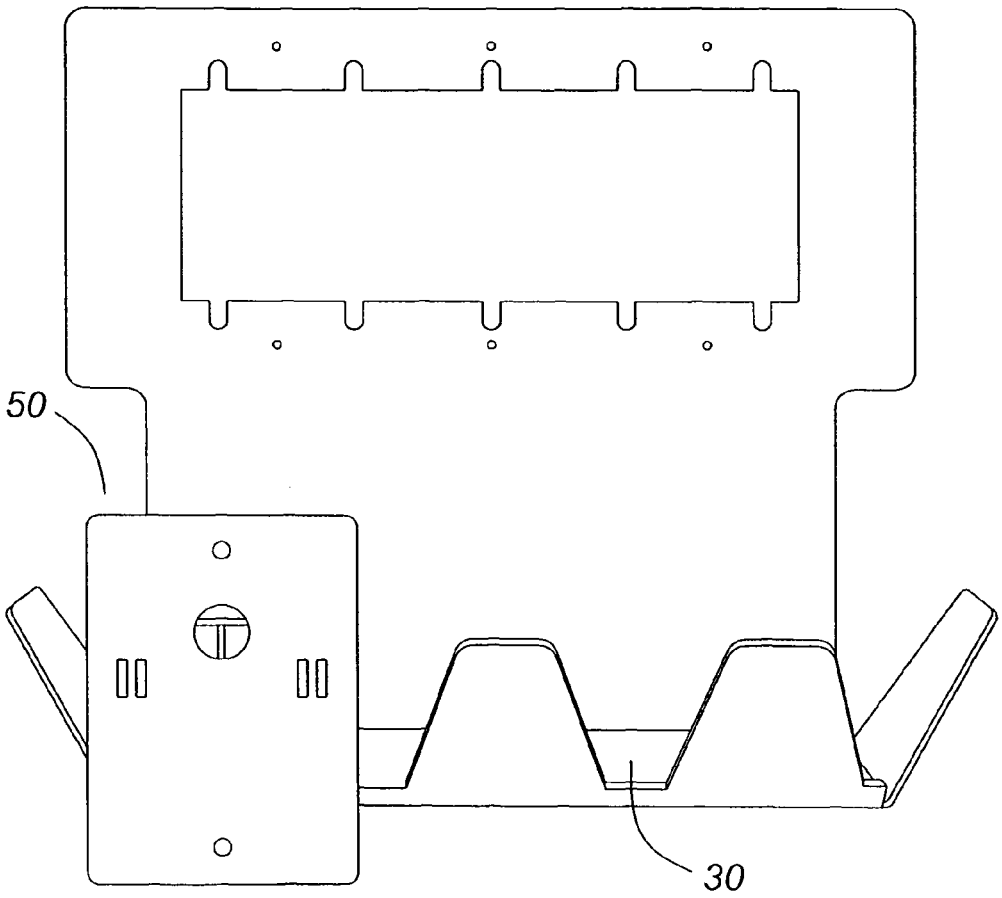
FIG. 4 is a front view of the embodiment shown in FIG. 1 with an attachment bracket of the invention.
Figure 5:
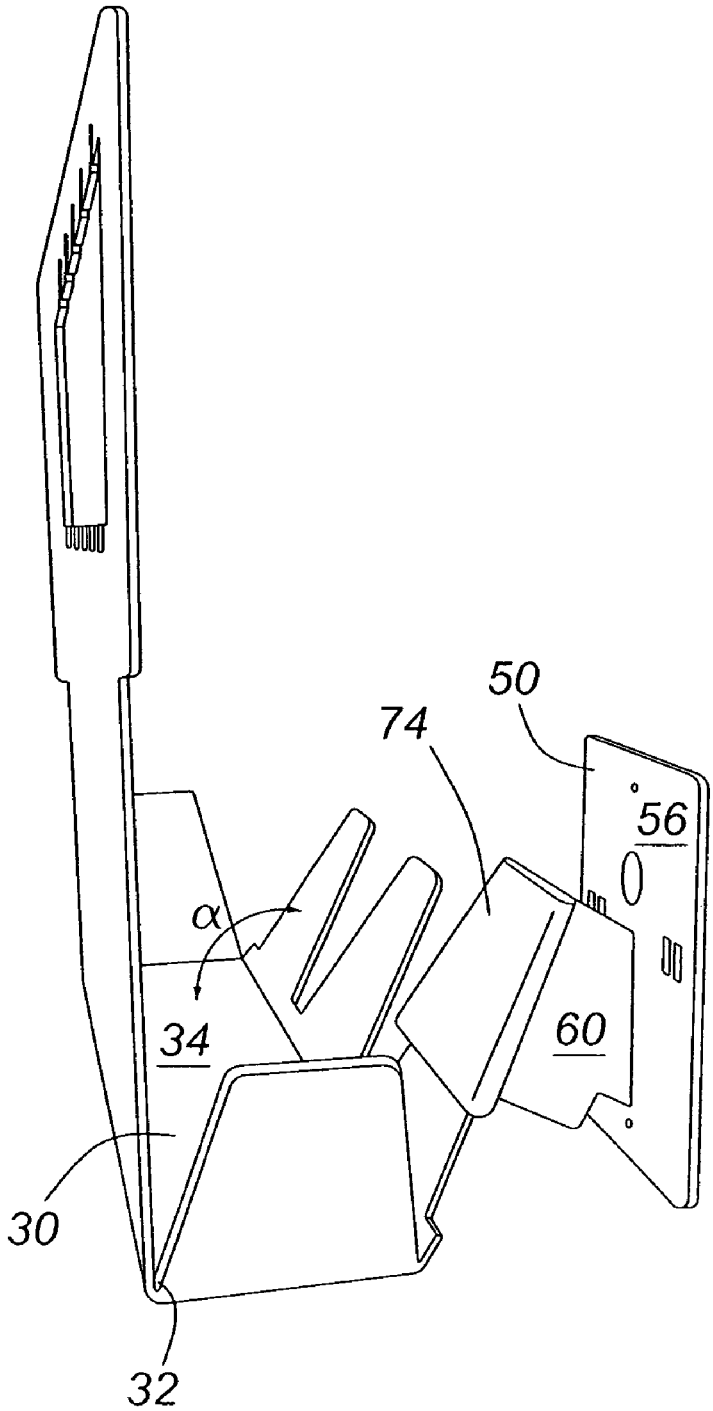
FIG. 5 is a perspective side view of the embodiment shown in FIG. 2.

FIGS. 2, 3 and 5 show aspects of a bracket 50 that may optionally be used with the device 1. The bracket 50 comprises a face plate 52 having a front surface 54 and a rear surface 56. The face plate 52 provides a surface for mounting items. The face plate 52 may receive and securely retain an item by various means, such as gravity or an interference fit. The face plate 52 has threaded holes 61, as in a standard electrical power box hole configuration, and which can serve as points of attachment for nurse call equipment and other items to the bracket 50. Additionally, the face plate 52 preferably has a plurality of holes 58 to accommodate item fastening means (not shown) to further secure the item to the face plate 52. An additional hole 59 accommodates a power cord (not shown) for a respective item. FIGS. 2 to 5 depict the front surface 54 of face plate 52 as being rectilinear in shape. However the front surface 54 could have any configuration which would appropriately accommodate the mounting of expected and intended items.

Referring now to FIGS. 2 to 5, the bracket 50 has a connector portion 60, which connects the rear surface 56 of the face plate 52 to a sleeve 70. The sleeve 70 has a front surface 72, a rear surface 74 and defines a channel 76. The sleeve 70, and particularly the channel 76, is configured to cooperate with a configuration of at least one of the projections 40. The sleeve may further comprise bracket fastening means (not shown) to secure the bracket 50 to the projection 40. Such securing means may prevent a distraught patient from removing the bracket 50 from a projection 40 in an attempt to damage or interfere with an item.

In a similar manner as noted above in relation to the projections 40, a protective material or coating can be applied to portions of the brackets 50.

FIGS. 4 and 5 show a bracket 50 being used in combination with the device 1. However, the device 1 may be used without the bracket 50 as shown in FIG. 1.

When being used in a patient care facility, the device 1 may be supplied with generic items, which are necessary for all patients, before a patient arrives. After a patient having particular medical needs arrives, the selection of items may be changed (by adding and/or removing items) to better suit the needs of the patient. Alternatively, the device 1 may not be supplied with any items until the medical needs of a patient are known.

Once the appropriate items are selected, they may be attached to the face plate 52 of bracket 50. If there is a concern that the patient may try to remove a bracket 50 from a projection 40 in an attempt to interfere with or damage an item, the bracket 50 may be secured to the projection 40 by bracket fastening means, as described above.

The invention claimed is:

1. A storage device for items connectable to a power source, the device being constructed and arranged to be attachable to an electrical power box on a support surface and comprising:

(i) a backing plate securable to the support surface and having an upper free edge and a lower region defining a substantially planar intermediate region therebetween, and a power supply aperture in the intermediate region constructed and arranged to allow a power connection between the power box and selected ones of the items;

(ii) a base shelf affixed to the lower region of the backing plate; and (iii) a plurality of projections extending from at least one free edge of the base shelf each constructed and arranged to provide securing locations for selected ones of the items;

wherein the base shelf is substantially rectilinear and each projection has substantially planar inner and outer surfaces and is angled outwards from an upper surface of the base shelf, such that the inner surface defines an obtuse angle $\alpha$ of less than 180° with the upper surface of the base shelf; wherein each projection has a tapered outer free end;

at least one securing means constructed and arranged to be received on any one of the projections and to selectively receive selected ones of the items;

wherein the least one securing means comprises an attachment bracket comprising:

a) a sleeve member configured to cooperate with a configuration of at least one of the projections;

b) a face plate member having a front surface and a rear surface and constructed and arranged to receive and securely retain selected ones of the items; and c) an intermediate connecting member attached to the sleeve member and the rear surface of the face plate member, wherein when the device is secured to the support surface and the sleeve member is located on one of the projections, the face plate member is retained in a substantially vertical position.

2. A device according to claim 1, wherein the intermediate connecting member is affixed to the face plate member at a joint region to define at a lower aspect of the joint region an obtuse angle substantially equal to the obtuse angle $\alpha$.

3. A device according to claim 1, wherein the face plate member is constructed and arranged to secure the selected ones of the items by gravity.

4. A device according to claim 1, wherein the face plate member is constructed and arranged to secure the selected ones of the items by an interference fit.

5. A device according to claim 1, wherein the face plate member further comprises securing locations constructed and arranged to receive fastening means to selectively secure the selected ones of the items to the face plate member.

6. A device according to claim 1, wherein the projections have a substantially triangular configuration having its apex at the tapered free end.

7. A device according to claim 1, wherein the power supply aperture is constructed and arranged to conform to a standard power box configuration selected from a single box, a four-by-four box and a multiple gang box.

8. A device according to claim 1, wherein the backing plate, the base shelf and the projections comprise an integrally constructed unit.

9. A device according to claim 8, wherein the integrally constructed unit is constructed of a material selected from metal or plastic.

10. A device according to claim 1, wherein at least portions of the device are provided with a protective material selected from a removable cover or a coating applied to selected surfaces of the device.

11. A device according to claim 1, wherein the attachment bracket is constructed of a material selected from metal or plastic.

12. A device according to claim 1, wherein at least portions of the attachment bracket are provided with a protective material selected from a removable cover or a coating applied to selected surfaces of the device.

* * * * *